US006484412B1

(12) United States Patent
Donaldson et al.

(10) Patent No.: US 6,484,412 B1
(45) Date of Patent: Nov. 26, 2002

(54) NON-SPILL CHALK LINE AND MEASURED REFILL CARTRIDGE

(75) Inventors: Joseph K. Donaldson, Villa Park, IL (US); Kevin M. Hanneman, Villa Park, IL (US); Christopher C. Mazczewski, Villa Park, IL (US); Craig W. Smith, Villa Park, IL (US)

(73) Assignee: Penshar, Inc., Batavia, IL (US)

( * ) Notice: Subject to any disclaimer, the term of this patent is extended or adjusted under 35 U.S.C. 154(b) by 12 days.

(21) Appl. No.: 09/677,426

(22) Filed: Oct. 2, 2000

Related U.S. Application Data

(63) Continuation-in-part of application No. 09/615,977, filed on Jul. 14, 2000.

(51) Int. Cl.[7] ..... B44D 3/38; B67D 3/00; B65D 43/12

(52) U.S. Cl. ..... 33/414; 33/761; 33/768; 141/364; 222/544; 206/816; 220/345.1

(58) Field of Search ..... 33/413, 414, 756, 33/761, 768; 141/364; 222/544; 206/816; 220/345.1

(56) References Cited

U.S. PATENT DOCUMENTS

| | | | | | |
|---|---|---|---|---|---|
| 523,189 | A | * | 7/1894 | Wilson | 33/414 |
| 2,563,865 | A | * | 8/1951 | Pottle | 220/345.1 |
| 2,749,618 | A | * | 6/1956 | Landon | 33/414 |
| 2,776,787 | A | * | 1/1957 | Nicol | 222/544 |
| 3,691,639 | A | * | 9/1972 | Roeseler | 33/414 |
| 4,062,385 | A | | 12/1977 | Katusha et al. | 141/89 |
| 4,459,761 | A | | 7/1984 | Bosco | 33/414 |
| 4,538,651 | A | * | 9/1985 | Lykins | 141/364 |
| 4,550,602 | A | * | 11/1985 | Burke, Sr. et al. | 73/428 |
| 4,806,039 | A | | 2/1989 | Kawamura | 401/208 |
| 5,108,016 | A | * | 4/1992 | Waring | 222/468 |
| 5,294,963 | A | * | 3/1994 | Nakano et al. | 141/364 |
| 5,335,855 | A | * | 8/1994 | Borod | 239/152 |
| 5,363,177 | A | * | 11/1994 | Nakano et al. | 141/364 |
| 5,513,679 | A | * | 5/1996 | Yamada | 141/364 |
| 5,520,229 | A | * | 5/1996 | Yamada | 141/364 |
| 5,538,161 | A | * | 7/1996 | Koehler et al. | 222/46 |
| 5,920,997 | A | * | 7/1999 | Girtman | 33/414 |
| 6,079,112 | A | * | 6/2000 | Love | 33/414 |

FOREIGN PATENT DOCUMENTS

| | | |
|---|---|---|
| FR | 2 679 950 | 2/1993 |

* cited by examiner

*Primary Examiner*—Randy W. Gibson
(74) *Attorney, Agent, or Firm*—Piper Rudnick; Michael L. Kenaga

(57) ABSTRACT

A chalk line device adapted to receive chalk from a chalk refill container, the chalk line device includes a body defining at least one opening and a chalk line disposed within the body. A mounting structure provided adjacent the opening is configured to engage the chalk refill container in a sealed manner, whereby chalk in the chalk refill container may be emptied into the chalk line device generally without spillage through engagement of the mounting structure to the chalk refill container. The refill container has a flange extending along its opening, and is sealed with a removable cover. A door is slidably mounted within the mounting structure such that opening and closing of the door is coordinated with coupling/decoupling of the refill container.

20 Claims, 5 Drawing Sheets

NON-SPILL CHALK LINE AND MEASURED REFILL CARTRIDGE

This application is a continuation in part of U.S. application Ser. No. 09/615,977 filed Jul. 14, 2000.

FIELD OF INVENTION

The present invention relates to a chalk line device, and in particular, a chalk line device and a mating chalk refill container.

BACKGROUND OF THE INVENTION

The construction industry uses chalk line devices to snap a line on lumber materials for assistance in cutting and otherwise providing measurement of lumber. Prior art devices often consist of a housing or body with a wound chalk line in the body. A chalk line device with colored chalk can be pulled from a small opening of the body. A clip at the end of the chalk line device can be hooked to the end of lumber for snapping the chalk line. Conventionally, chalk line devices are replenished with chalk by inserting the tip of a chalk refill bottle into a relatively small opening in the chalk line device body. Since the chalk line device body is small and requires frequent refills, tradesmen often have to carry a large one gallon container of chalk with them to remote sites for refilling the chalk line device.

Since the openings of existing chalk line devices are small, spillage of the chalk often occurs during refills. Chunks of chalk often burst through the refill bottle's nozzle, rebound out of the chalk line device and create a mess. Humidity can also cause the chalk to harden, making refilling more difficult. Current refill bottles are large and awkward. As such, they are not convenient to carry in a tool pouch. Tradesman therefore do not typically carry chalk line device refills with them, and often run out of chalk at a remote location far from a refill container. The tradesmen also have difficulty in gauging how much chalk to dispense into the chalk line device body. As a result, the chalk line device is filled beyond its ideal capacity. Thus, there is a long unfulfilled need to provide a chalk line device and chalk refill container system that is more efficient and easier to use.

SUMMARY OF INVENTION

It is an object of present invention to provide a chalk line device configured for efficient filling of chalk.

It is another object of the invention to provide a chalk refill container that is easier and more efficient to use.

Therefore, the present invention provides a chalk line device with a body that is adapted to be refilled using a chalk refill container. Chalk line is wound within the chalk line device body. The chalk line device body has a coupling structure provided near a refill opening. A door is operationally engaged with the coupling structure and seals the opening.

The present invention also provides a chalk refill container having a pair of opposing flanges for engaging with the coupling structure of the chalk line device body. An opening is provided between the flanges, and a removable cover for sealing the opening of the container is releasably secured to the flange. In operation, the cover is removed and the chalk refill container is coupled to the chalk line device via engagement of the flanges with the chalk line device. Chalk is dispensed from the coupled chalk refill container into chalk line device by inverting the coupled unit.

BRIEF DESCRIPTION OF DRAWINGS

The above and other features of the invention will be explained with reference to the attached drawings in which.

DETAILED DESCRIPTION OF THE INVENTION

Figure 1:
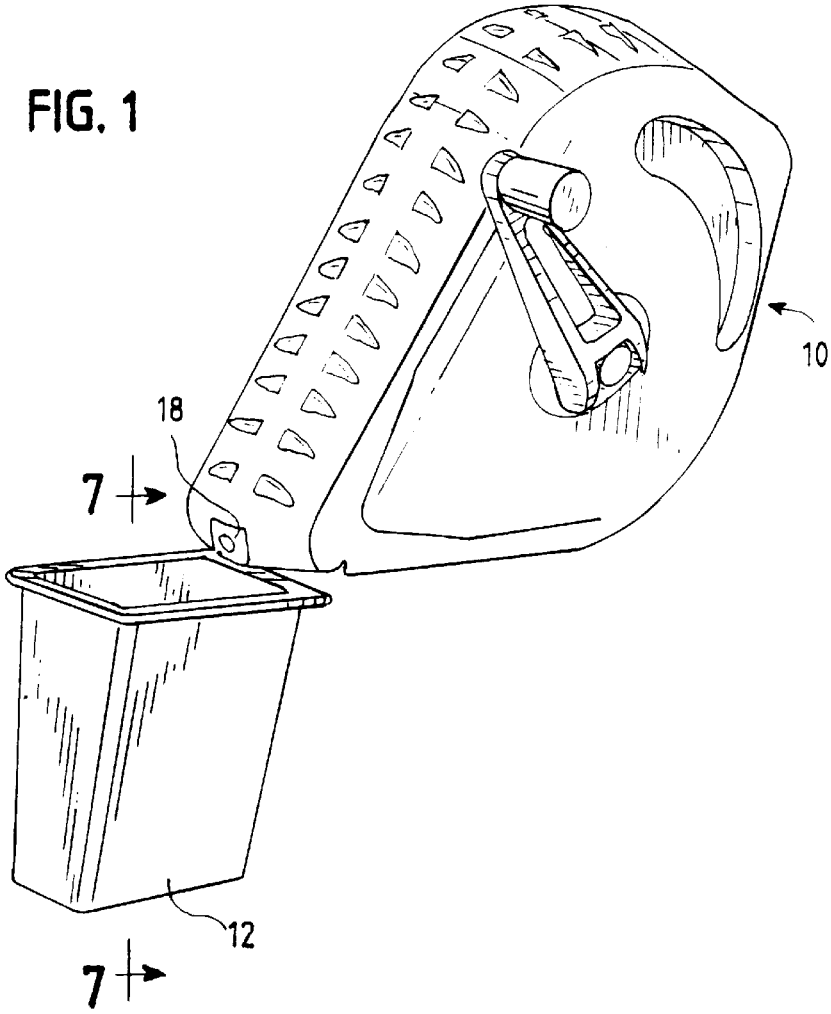
FIG. 1 is a perspective view of a chalk line device and a chalk refill container as the latter is being slid into the refill position.
Figure 2:
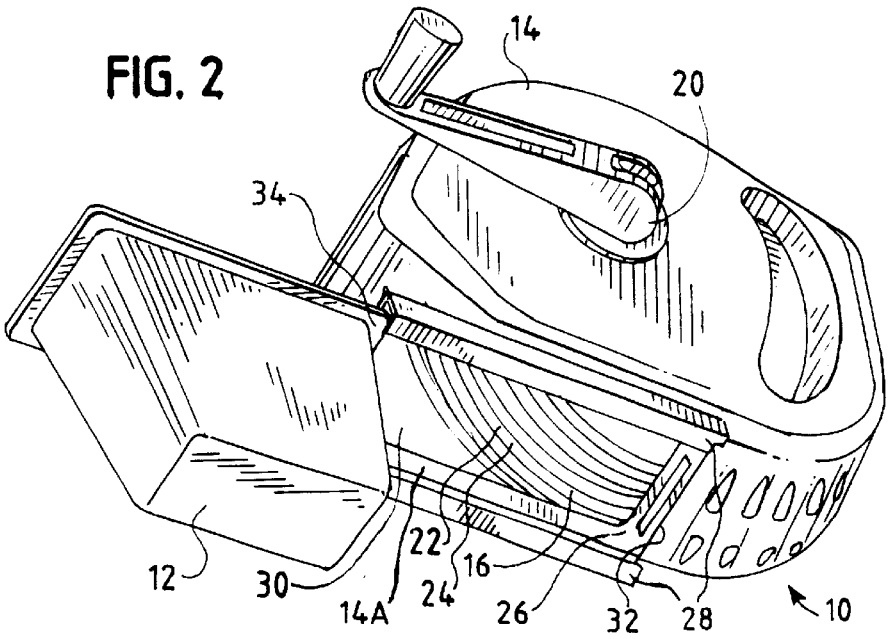
FIG. 2 is another perspective view of the chalk line device and the chalk refill container of FIG. 1.

FIG. 1 shows a chalk line device, indicated in general at 10, and a chalk refill container 12 constructed in accordance with the present invention. As illustrated in FIG. 2, the chalk line device 10 has a chalk line housing 14 in which a conventional spool 16 is mounted. Chalk line 22 is wound about the spool 16. Clip 18 (FIG. 1) is connected to the end of chalk line 22, and facilitates attachment of the chalk line to a material being marked such as, for example, lumber. According to a preferred embodiment, the housing 14 has a generally flat mounting surface 14A to facilitate attachment of the chalk refill container 12.

FIG. 2 shows a crank 20 which is coupled to the spool 16. The crank 20 is actuated to wind the chalk line 22 about the spool 16, thereby retracting the chalk line 22 into cavity 24 of the chalk line housing 14. The chalk line housing 14 has a refill opening 30 bordered by a pair of generally parallel flanges 26. The flanges 26 define opposing tracks 28 extending along the sides of chalk line housing 14, and extend at least the full length of the refill opening 30.

Figure 3:
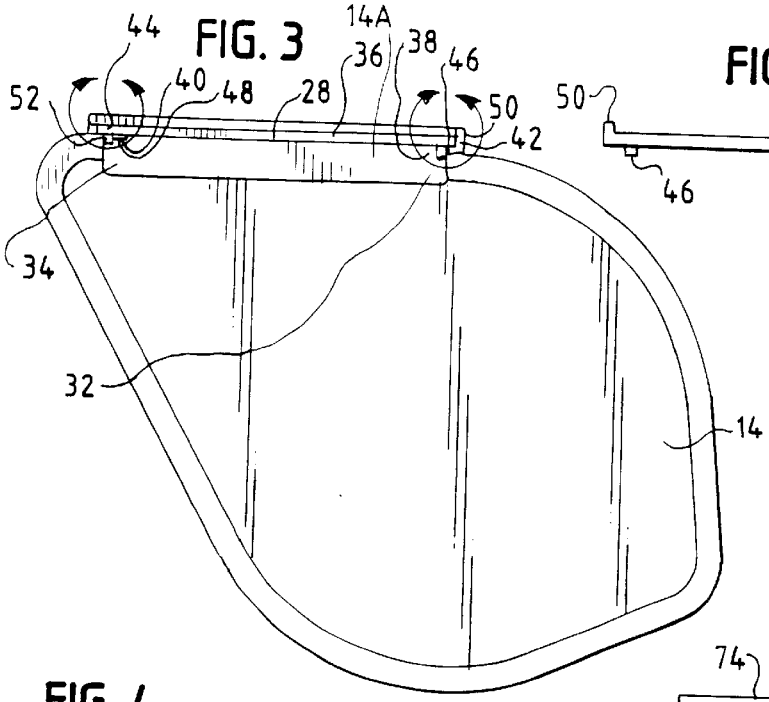
FIG. 3 is a side view of the chalk line device with its door in the closed position.
Figure 5:
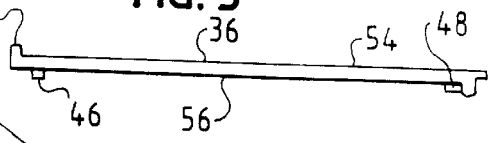
FIG. 5 is a side view of the door of the chalk line device.

FIG. 3 shows a first recess 38 formed in a first edge 32 of surface 14A. Similarly, a second recess 40 is formed in a second edge 34 of the surface 14A. According to a preferred embodiment (FIG. 9A), the flanges 26 include a generally flat portion 26A and a generally curved portion 26B.

A chalk line door 36 will now be explained with reference to FIGS. 3–6, 9A–11B. The chalk line door 36 has a first end 42 and a second end 44. The door 36 is configured to travel within the opposing tracks 28. Preferably, the door 36 is formed of a resilient, flexible material such that the door 36 conforms to the curvature of portion 26B. Alternatively, the door 36 may include plural segments 36A, where adjacent segments are coupled by a living hinge 36B to enable the door 36 to conform to the curvature of portion 26B. See, FIG. 10.

Figure 9A:
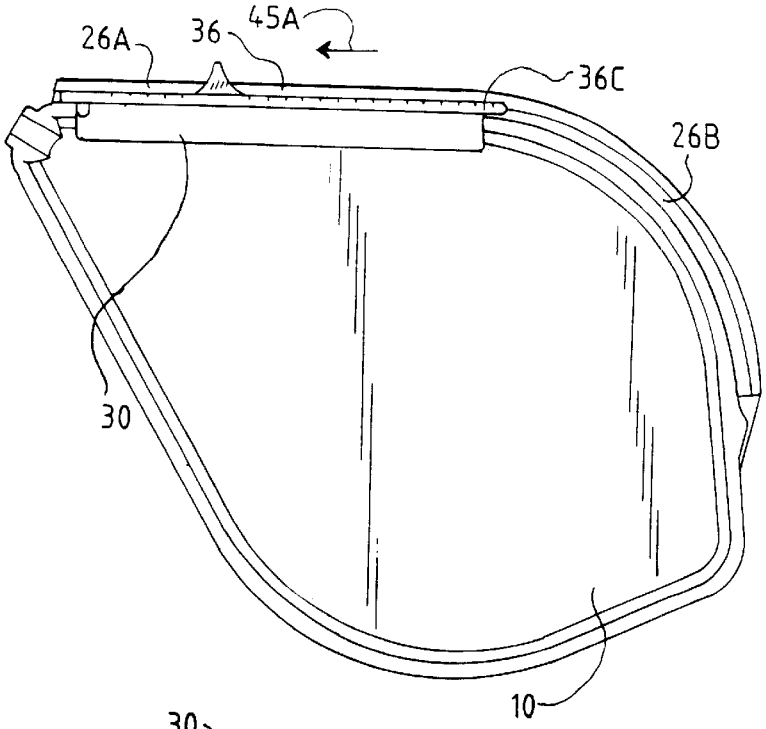
FIG. 9A is a perspective view of a chalk line device with the door in a closed position.
Figure 9B:
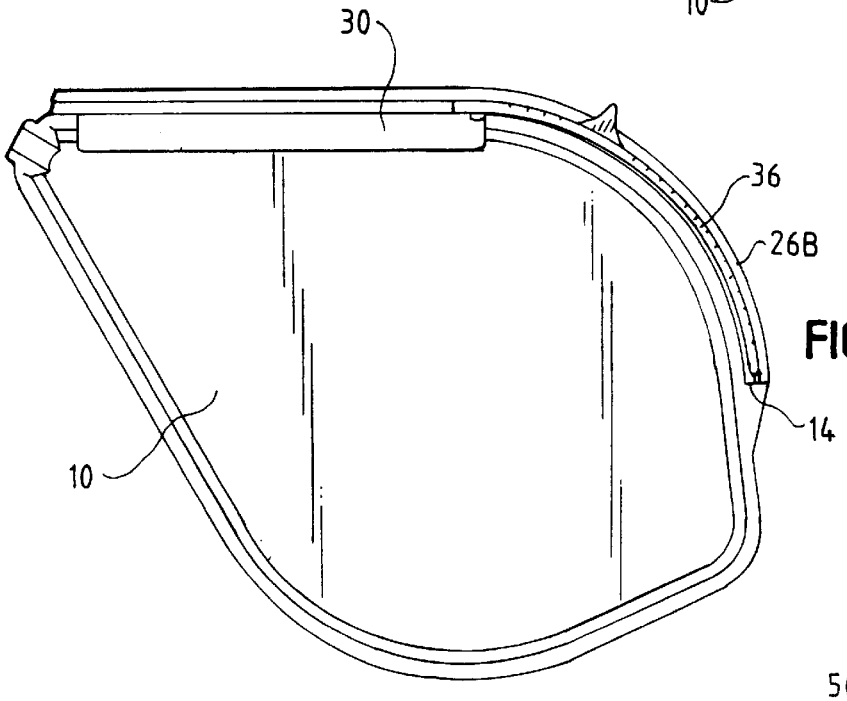
FIG. 9B is a perspective view of a chalk line device with the door in an open position.
Figure 10:
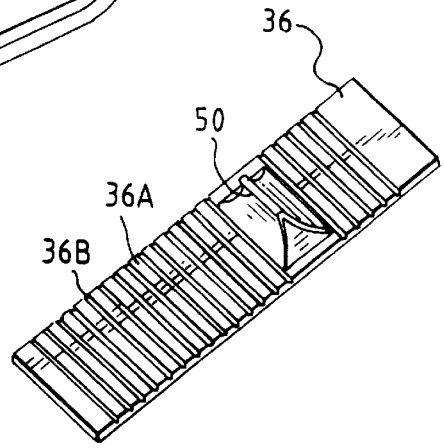
FIG. 10 is a perspective of the door in the chalk line device of FIGS. 9A and 9B.

A preferred aspect of the door 36 will be explained with reference to FIGS. 9A and 9B in which the length of the door 36 is configured to slightly exceed the length of the generally flat portion 26A. FIG. 9A depicts the chalk line device 10 with the door 36 in a closed position in which the refill opening 30 is sealed. In this condition, portion 36C of the door 36 extends into the curved portion 26B. Interference between the curvature of portion 26B and portion 36C exerts a pressure in the direction shown by arrow 45A when the door is in a closed position, thereby providing resistance to opening of the door 36. In this manner, accidental opening of the door 36 is avoided.

Additionally, as the door 36 is retracted into an open position (FIG. 9B), the door 36 deforms to conform to the curvature of curved portion 26B. Snagging and/or breakage of the door 36 is prevented by ensuring that the door 36 conforms to and does not extend away from the exterior surface of the chalk line housing 14.

Figure 4:
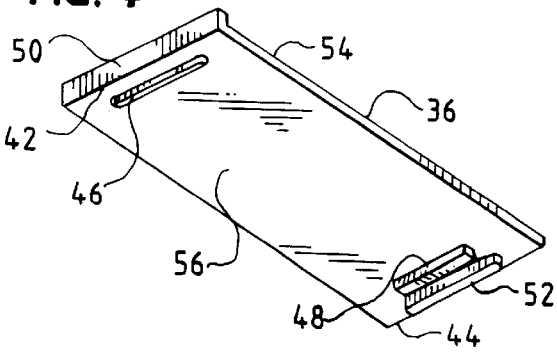
FIG. 4 is a perspective view of the door of the chalk line device.

Turning now to FIG. 4, a first detent 46 is formed in door 36 adjacent end 42, and a second detent 48 is formed in door 36 adjacent end 44. As best seen in FIG. 3, when the door 36 is in a closed position, first detent 46 engages first recess 38 while second detent 48 engages second recess 40. The engagement of the detents 46, 48 into the corresponding recesses 38, 40 further prevents accidental opening of the door 36.

Figure 6:
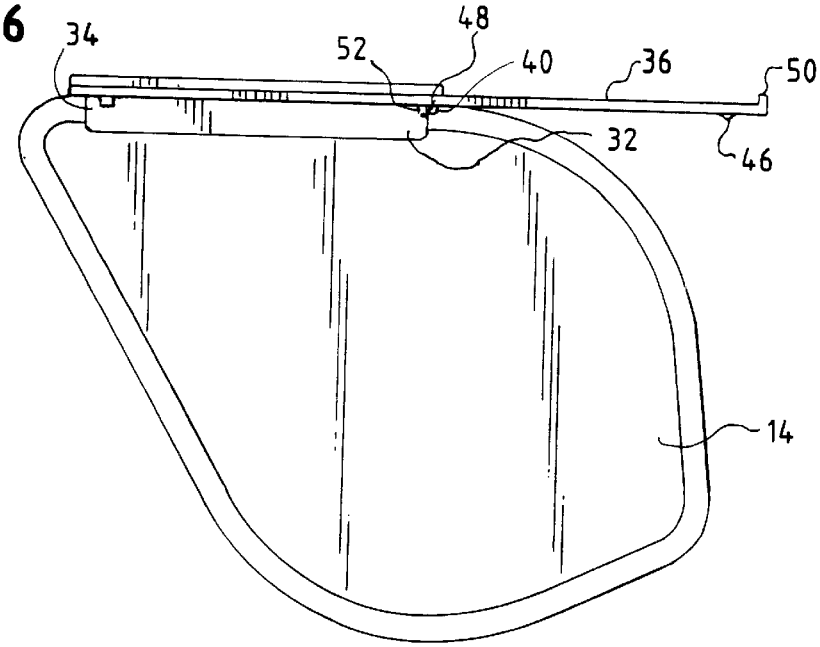
FIG. 6 is a side view of the chalk line body of FIG. 3 with its door in the open position.

Opening of the door 36 is facilitated by a lip 50 attached to outer face 54 of the chalk line door 36. See, FIGS. 4 and 5. A stop 52 attached to inner face 56 of the chalk line door 36 is configured to engage the second edge 34, thereby limiting the range of movement in opening/closing directions of the chalk line door 36. FIG. 6 shows the chalk line door 36 in an open position in which the stop 52 engages the first edge 32 of surface 14A to limit the movement of the chalk line door 36.

Figure 7:
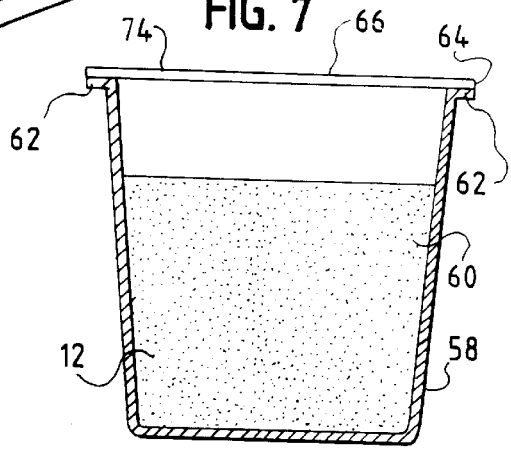
FIG. 7 is a cross section view of the chalk refill container of FIG. 1 taken along line 7—7 of FIG. 1.

FIG. 7 shows a chalk refill container 12 featuring a refill container housing 58 containing chalk 60. Container housing 58 features an opening 74, and is preferably constructed from transparent material such as plastic. A chalk refill flange 62 is positioned along the sides of the refill container housing 58. A sealing material 66 covers the opening 74 of the chalk refill container 12 and is attached to the chalk refill flange 62 by, for example, an adhesive material 64.

Figure 8:
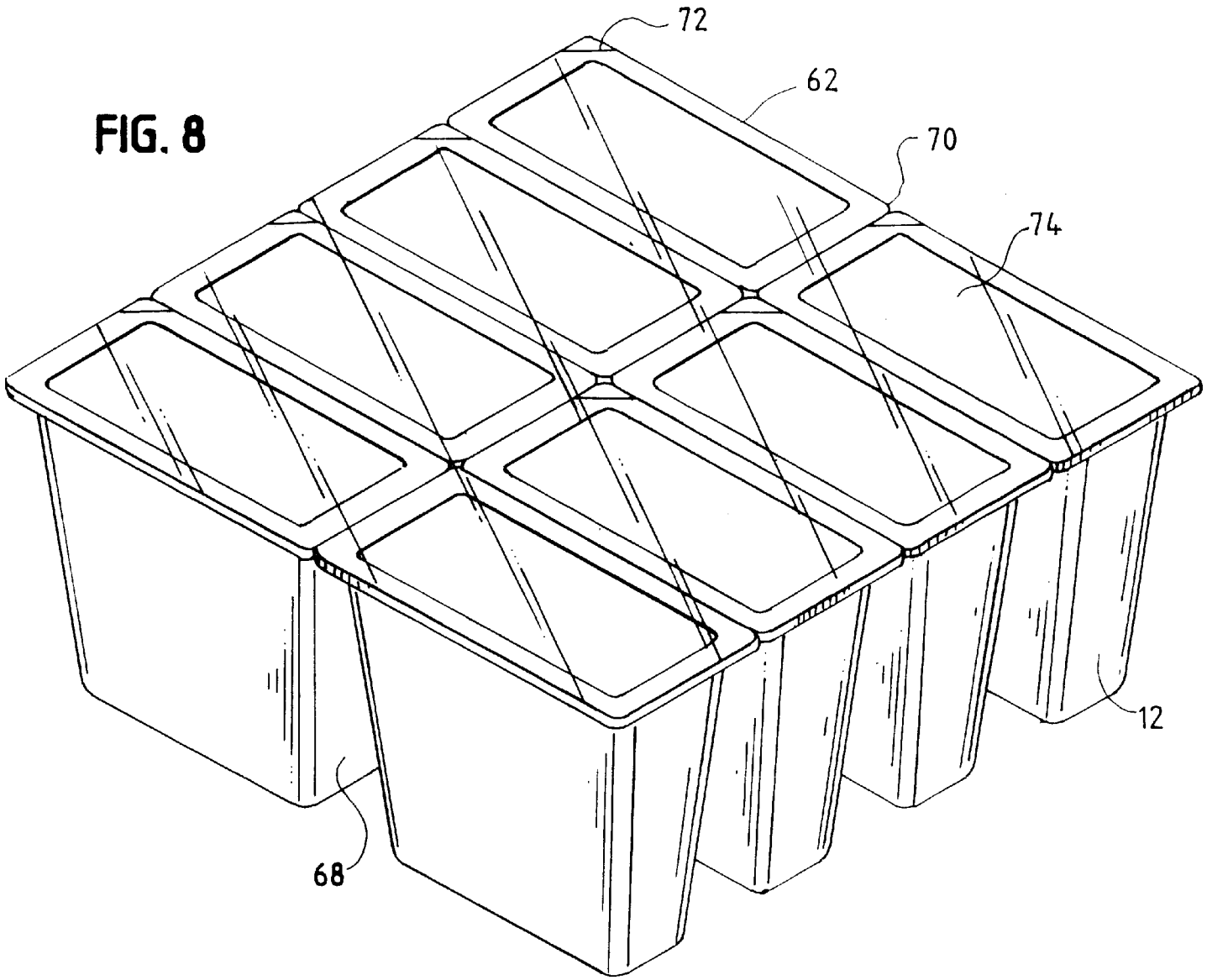
FIG. 8 is a side perspective view of a set of chalk refill containers.

FIG. 8 illustrates how a number of individual chalk refill containers 12 may be molded as a one piece unit 68 facilitating rapid filling and sealing of the individual chalk refill containers 12.

Separation of an individual chalk refill container 12 from the one piece unit 68 is facilitated by a perforation 70 provided between the flange 62 of adjacent containers 12. Further, the chalk refill flange 62 of each container 12 is provided with a frangible portion 72 to facilitate removal of the sealing material 66. In use, the frangible portion 72 is separated from the flange 62, and the sealing material 66 is then peeled back from the flange 62 to expose the opening 74.

Figure 11A:
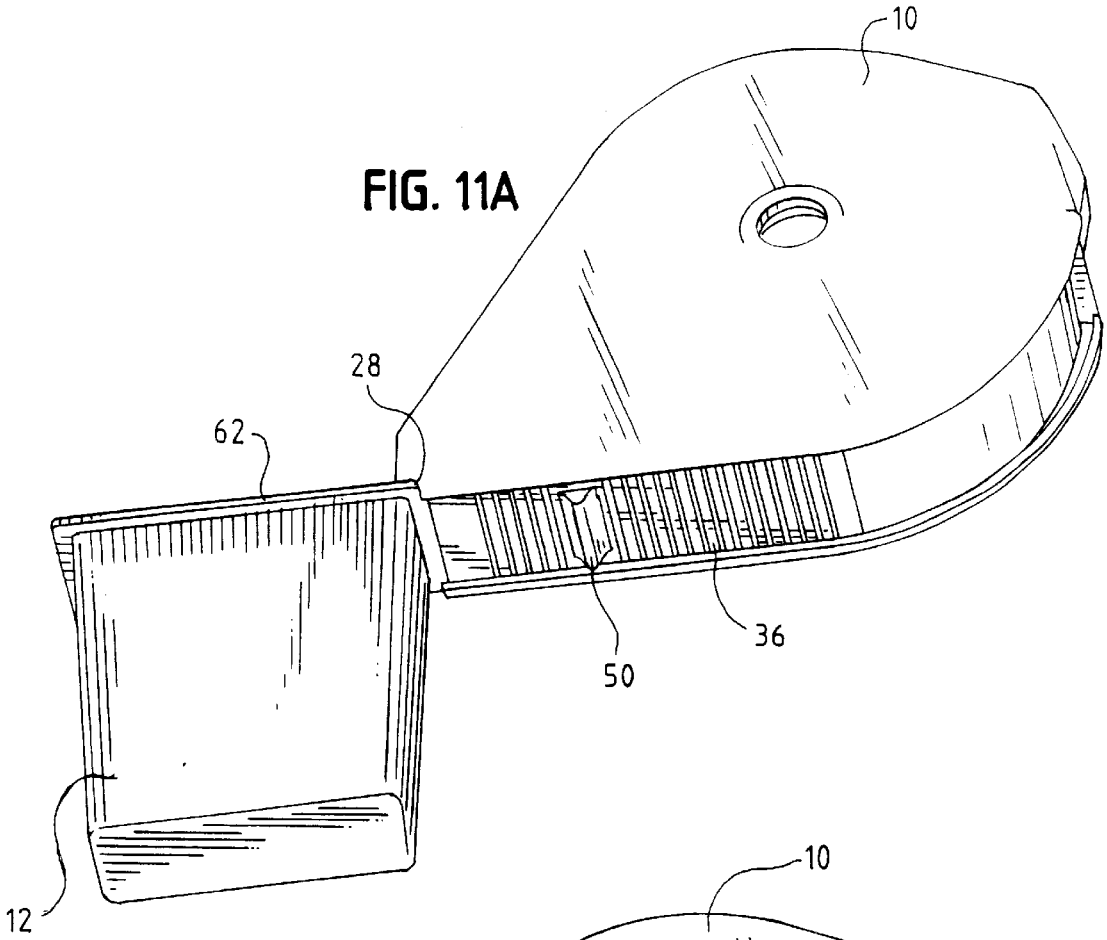
FIG. 11A is a perspective view of a chalk line device and a chalk refill container as the latter is being slid into the refill position.
Figure 11B:
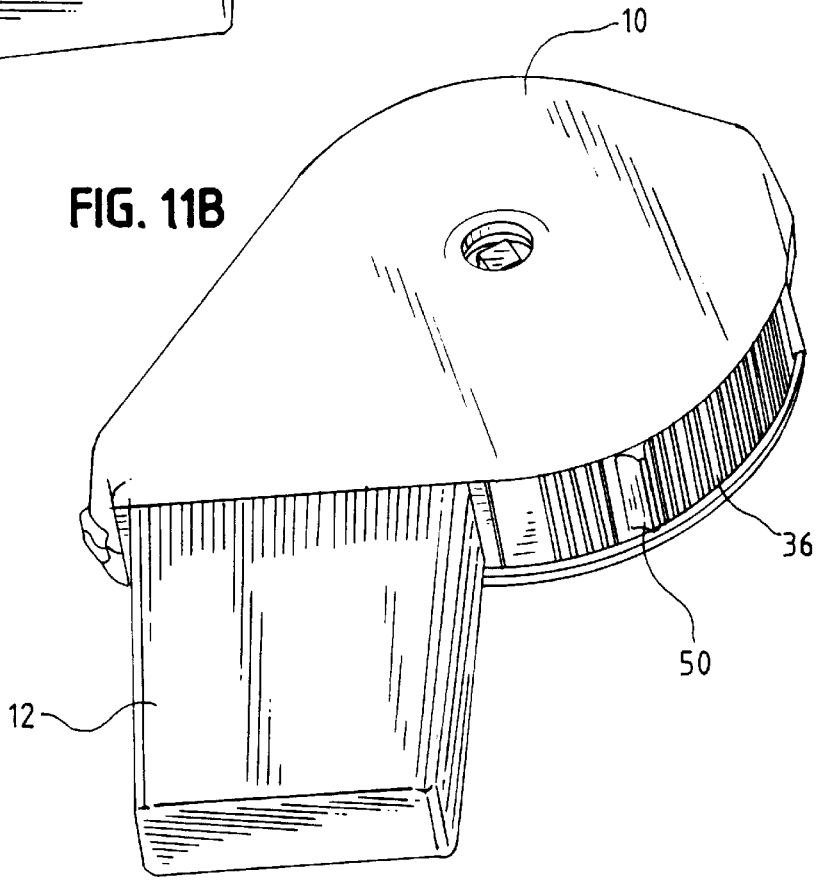
FIG. 11B is another perspective view of the chalk line device and the chalk refill container of FIG. 11A.

Dispensing of chalk into the chalk line device 12 will now be explained with reference to FIGS. 1, 2, 11A and 11B. Dispensing of chalk according to the present invention requires that the chalk line device 10 be sealably connected to the refill container 12. This is achieved by holding the chalk line device 10 with the chalk line door 36 (FIG. 3) facing down while orienting the chalk refill container 12 (with sealing material 66 removed) so that the flange 62 (FIG. 7) engages the tracks 28 (FIGS. 2 and 11A) of the chalk line housing 14. This action forces the chalk line door 36 to move to the open position (FIGS. 6 and 11B). The chalk line door 36 is gradually urged open as the refill container 12 is pushed further along tracks 28. The entire assembly, which consists of the chalk line device 10 coupled to the chalk refill container 12, is then turned upside down so that the chalk in the refill container 12 is emptied into the cavity 24 (FIG. 2) of the chalk line device 10.

According to a preferred embodiment the refill container 12 contains a measured quantity of chalk. In this manner overfilling of the chalk line housing 14 is prevented. Moreover, the engagement of the chalk refill flange 62 to the tracks of the 28 of the chalk line device generally prevents spillage of the chalk.

Once the measured quantity of chalk has been dispensed, the chalk line housing 14 is subsequently resealed by closing the door 36. Importantly, the door 36 pushes the chalk refill container 12 along the tracks 28. In this manner removal of the chalk refill container 12 is accomplished simultaneously with closing of the door 36, thereby preventing spilling of the chalk.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

What is claimed is:

1. A chalk line device, the chalk line device adapted to receive chalk from a chalk refill container, the chalk line device comprising:

a) a body defining at least one opening;

b) a chalk line disposed within said body; and c) means for coupling said chalk line device to the chalk refill container in a sealed manner, and with the container disposed substantially external to the chalk line device, said coupling means includes a track extending along said body, whereby the chalk refill container couples to said body via the track, and chalk in the chalk refill container is emptied into the chalk line device generally without spillage through coupling of said coupling means to the chalk refill container.

2. The chalk line device of claim 1, wherein said track includes two parallel and opposing tracks extending along said body, whereby the chalk refill container couples to said body via said two parallel and opposing tracks.

3. The chalk line device of claim 2, further comprising:

a) a door engaged with said two tracks, said door being movable between a closed position in which said door seals said at least one opening and an open position in which said at least one opening is exposed;

b) wherein said door is opened by the chalk refill container as the chalk refill container slides into engagement with said two tracks;

c) further wherein the chalk refill container is disengaged from the chalk line device by said door as said door is urged into a closed position in which said at least one opening is sealed.

4. The chalk line device of claim 2, wherein each of said two tracks includes a generally flat portion and a generally curved portion, and a length of said door generally exceeds a length of said flat portion such that said door interferes with said curved portion thereby preventing accidental opening of said door.

5. The chalk line device of claim 4, wherein said door is flexible and generally conforms to a curvature of said curved portion as said door is moved into said open position.

6. The chalk line device of claim 4, wherein said door is comprised of a plurality of segments with a living hinge connecting adjacent segments.

7. The chalk line device of claim 3, wherein:

a) said at least one opening includes a first edge and a second edge;

b) said body includes a recess adjacent one of the first and second edges;

c) said door has first and second ends and an inner face, a first detent located on said inner face adjacent to said first end, and a second detent located on said inner face adjacent to said second end, whereby said first detent is in locking engagement with said recess in a door closed position, and said second detent is in locking engagement with said recess in a door opened position.

8. The chalk line device of claim 7, wherein said door includes a stop on said inner face adjacent said second end, whereby said stop engages said first edge to limit opening of said door, and said stop engages said second edge to limit closing of said door.

9. The chalk line device of claim 3, wherein:

a) said body includes a cavity and a wall;

b) said wall includes said at least one opening;

c) said door slides upon said wall and is generally located outside of said cavity; and d) whereby said end of said door is exposed for engagement with the chalk refill container.

10. The chalk line device of claim 7, further comprising a recess adjacent to the second edge, whereby a chalk refill container may be secured in locking engagement with the chalk line device by means of a detent on the refill container being received by the recess adjacent to the second edge.

11. The chalk line device of claim 1, wherein said chalk line device body has a length, a width and a refill opening, the refill opening has a length and a width, the refill opening length extends approximately one half of the length of the body, and the refill opening width extends across substantially the entire width of the body.

12. A chalk refill container for dispensing a measured quantity of chalk into a chalk line device, the chalk line device having a chalk refill opening with a width and a length, the width and length define a perimeter, the chalk line device also includes tracks for coupling to the chalk refill container, the tracks extend along the length of the opening, the chalk refill container comprising:

a) a container housing for storing chalk, said container housing having an opening of a rectangular shape, the opening defines a perimeter, the perimeter of the container opening is substantially the same as the perimeter of the chalk line device;

b) chalk within the container housing;

c) means for coupling said container housing to the chalk line device with the container disposed substantially external to the chalk line device and with the perimeter of the housing aligned with the perimeter of the container, said coupling means includes a pair of flanges extending along a length of said opening; and d) a removable cover releasably secured to the container housing and sealing said container opening;

whereby the chalk refill container is coupled to a chalk line device by mating engagement of the flanges with the tracks.

13. The chalk refill container of claim 12, wherein the container housing is transparent, whereby a user may observe all of the chalk being emptied into the chalk line device.

14. The chalk refill container of claim 12, wherein said removable cover is composed of foil, and is sealed along the flange and over the opening of said chalk refill container via a releaseable adhesive.

15. The chalk refill container of claim 12, wherein said flange includes a frangible portion, whereby said container housing opening is exposed by separating said frangible portion from said flange and pealing said removable cover from said flange.

16. A chalk dispensing system comprising:

a) a chalk refill container including:

i) a chalk refill container housing for storing a measured quantity of chalk, said housing defining a refill container opening;

ii) chalk within the container housing;

iii) a flange extending along said refill container opening;

iv) a removable cover secured to said container housing and sealing said refill container opening;

b) a chalk line device including:

i) a chalk line device body defining an opening;

ii) a chalk line disposed within the chalk line device body;

iii) first and second rails on opposing sides of said device body opening, said rails including an engagement portion configured to slidably engage said flange;

iv) a door engaged with said engagement portion, said door being movable between a closed position in which said door seals said chalk line device body opening and an open position in which said chalk line device body opening is exposed;

c) whereby chalk is dispensed from said chalk refill container into chalk line device body by exposing said refill container opening by removing said removable cover, coupling said flange with said engagement portion, and inverting said chalk refill container wherein said door is opened by the chalk refill container as the chalk refill container slides into engagement with said engagement portion, further wherein said chalk refill container is disengaged from said chalk line device by said door as said door is urged into said closed position.

17. The chalk dispensing system of claim 16, wherein said engagement portion includes a pair of tracks, said pair of tracks having a generally flat portion and a generally curved portion, and a length of said door generally exceeds a length of said flat portion such that said door interferes with said curved portion thereby preventing accidental opening of said door.

18. A chalk line device, the chalk line device adapted to receive chalk from a chalk refill container, the chalk line device comprising:

a) a body having a length, a width and a refill opening, the refill opening has a length and a width, the refill opening length extends approximately one half of the length of the body, and the refill opening width extends across substantially the entire width of the body;

b) a chalk line disposed within said body;

c) means for coupling said chalk line device to the chalk refill container in a sealed manner, whereby chalk in the chalk refill container is emptied into the chalk line device generally without spillage through coupling of said coupling means to the chalk refill container.

19. The chalk line device of claim 18, wherein said coupling means includes two parallel and opposing tracks extending along said body, whereby the chalk refill container couples to said body via said two parallel and opposing tracks.

20. The chalk line device of claim 19, further comprising:

a) a door engaged with said two tracks, said door being movable between a closed position in which said door seals said refill opening and an open position in which said refill opening is exposed;

b) wherein said door is opened by the chalk refill container as the chalk refill container slides into engagement with said two tracks;

c) further wherein the chalk refill container is disengaged from the chalk line device by said door as said door is urged into a closed position in which said refill opening is sealed.

* * * * *